US006094820A

United States Patent [19]

Adachi

[11] Patent Number: 6,094,820

[45] **Date of Patent: *Aug. 1, 2000**

[54] RAZOR COMB BLADE UNIT

[75] Inventor: Hidemi Adachi, Gifu, Japan

[73] Assignee: Adachi Kogyo, Inc., Gifu-Ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/048,362

[22] Filed: Mar. 26, 1998

[30] Foreign Application Priority Data

Mar. 26, 1997 [JP] Japan ..... 9-073571

[51] Int. Cl.[7] ..... B26B 21/12

[52] U.S. Cl. ..... 30/30; 30/63; 30/335

[58] Field of Search ..... 30/30, 63, 163, 30/164, 335

[56] References Cited

U.S. PATENT DOCUMENTS

| | | | |
|---|---|---|---|
| 1,587,656 | 6/1926 | Kojima | 30/30 |
| 1,866,475 | 7/1932 | Loughmiller | 30/30 |
| 2,530,918 | 11/1950 | Taylor | 30/30 |
| 2,536,485 | 1/1951 | Behr | 30/30 |
| 2,896,320 | 7/1959 | Caplan | 30/30 |
| 3,041,721 | 7/1962 | Quino, Sr. | 30/30 |
| 3,384,960 | 5/1968 | Soloman | 30/30 |
| 3,409,981 | 11/1968 | Beverly | 30/30 |
| 3,421,213 | 1/1969 | Pawlikowski | 30/30 |
| 4,009,517 | 3/1977 | Horn | 30/30 |
| 4,319,399 | 3/1982 | Ciaffone | 30/30 |
| 4,663,841 | 5/1987 | Custer | 30/30 |
| 5,461,780 | 10/1995 | Morana | 30/30 |

*Primary Examiner*—M. Rachuba
*Attorney, Agent, or Firm*—Perkins, Smith & Cohen, LLP

[57] ABSTRACT

A blade unit for a razor comb which can be used equally in two hair cutting directions is disclosed. The blade unit comprises a blade and a blade holder partially housing the blade. The blade holder has two edges, both of which are provided with a plurality of protrusions for combing hair. The protrusions partially cover the blade edge, leaving a plurality of uncovered blade edge portions for cutting hair. The covered blade edge portions and uncovered blade edge portions have an equal length and are provided alternately. The blade unit can be additionally provided with an appropriate blade sliding means for exchanging the covered and uncovered blade edge portions to refresh the cutting portions of the blade.

13 Claims, 8 Drawing Sheets

RAZOR COMB BLADE UNIT

BACKGROUND OF THE INVENTION

1. Field of the Invention

This invention generally relates to a razor comb. More particularly, this invention relates to a spare razor blade unit for a razor comb. The razor blade unit of the present invention can elongate the life of its blade by facilitating alternate utilization of blade portions.

2. Prior Art

In FIG. 14 is shown a conventional spare-type hair razor blade unit 1' comprising a blade 3 and a blade holder 2. The blade 3 has two surfaces 3*a* and 3*c* and a blade edge 5. The blade holder 2 comprises two surfaces 2*a* and 2*b* connected with a backbone 2*c*, which is formed by bending a metal plate. The holder surface 2*a* has a straight edge 20*a* while the surface 2*b* has a wavy edge 20*b* having a plurality of parabolic protrusions 4*b*. The two edges 20*a* and 20*b* provide a slit therebetween for securely holding the blade 3. The blade edge 5 protrudes from the slit. The blade 3 is sandwiched between two holder surfaces 2*a* and 2*b* with the parabolic protrusions 4*b* for combing hair protruding beyond the blade edge 5. The parabolic protrusions 4*b* partially cover the blade edge 5 of the blade surface 3*b* while the blade edge 5 of the blade surface 3*a* is left uncovered, providing covered blade portions B and uncovered blade portions A for cutting hair. As can be seen in the figure, blade portions A and B appear on the blade edge 5 alternately. This razor blade unit 1' can be attached to and detached from a blade unit holder not shown in this figure.

In FIG. 15 is shown another conventional spare-type razor blade unit 1" disclosed in Japanese Patent Application No. 7-67847 filed by the present applicant, which is nearly identical with the foregoing razor blade unit 1' except that this razor blade unit 1" further comprises an elliptic window 6 provided in the holder surface 2*a* to receive a boss 3*d* fixedly provided on the blade surface 3*a*. The sliding of the boss 3*d* with a finger along the elliptic window 6 facilitates the blade 3 to slide within the blade holder 2 in the directions shown by arrows. Thus, this razor blade unit 1" facilitates alternate use of blade portions A and B. The covered blade portions B turn into uncovered blade portions A. The blade edge 5 of the razor blade unit 1" can be used theoretically twice as long as that of the razor blade unit 1'.

As will be understood by a person skilled in the art, a razor comb incorporating either razor blade unit 1' or 1" can be appropriately used only by either a right-handed person or left-handed person since the razor blade units 1' and 1" can provide adequate cutting of hair in a single direction only because the cutting performance of the blade edge 5 is subtly different between the two cutting directions. Therefore, such conventional razor blade units are utilized "reversely" between left-handers and right-hander. Additionally, a single user, left-hander or right-hander, often wishes to use a razor comb in both directions to trim hair by reversing the attachment (to the blade unit holder) of the razor blade unit. Such a reversing of the blade unit when required often is very inconvenient and impractical.

SUMMARY OF THE INVENTION

Accordingly, it is an object of the present invention to provide a razor blade unit which eliminates difference in trimming performance between the two hair cutting directions.

It is another object of the present invention to further furnish such a razor blade unit with blade portion switching means and provide an elongated life to the blade.

A razor blade unit of the present invention comprises a razor blade and a blade holder. Unlike the foregoing conventional razor combs, both holder edges are provided with a wavy pattern and have parabolic protrusions appearing alternately. Accordingly, the functional difference between the two hair cutting directions has disappeared. The upper protrusions and lower protrusions partially cover the blade edge and provide a plurality of covered blade edge portions and a plurality of uncovered blade edge portions for cutting hair.

The razor blade unit of the present invention can be additionally provided with a blade sliding means for sliding the blade within the blade holder to convert the covered blade portions into uncovered blade portions, and vice versa, elongating the life of the blade about twice that of a blade unit without such a blade sliding means.

The blade sliding means utilizable in the blade unit of the present invention may be a combination of a window provided in the blade holder and a boss provided on the blade, a through opening formed in the blade holder and a through hole formed in the blade, or a cut or cuts formed in the blade holder and a cut or cuts formed in the blade.

BRIEF DESCRIPTION OF THE DRAWINGS

FIG. 3(*b*) is a plan view of the razor blade unit of FIG. 2 showing the other blade position;

FIG. 6(*b*) is a plan view of the blade unit of FIG. 6(*a*) showing the other blade position;

DETAILED DESCRIPTION OF THE PREFERRED EMBODIMENT

Figure 1:
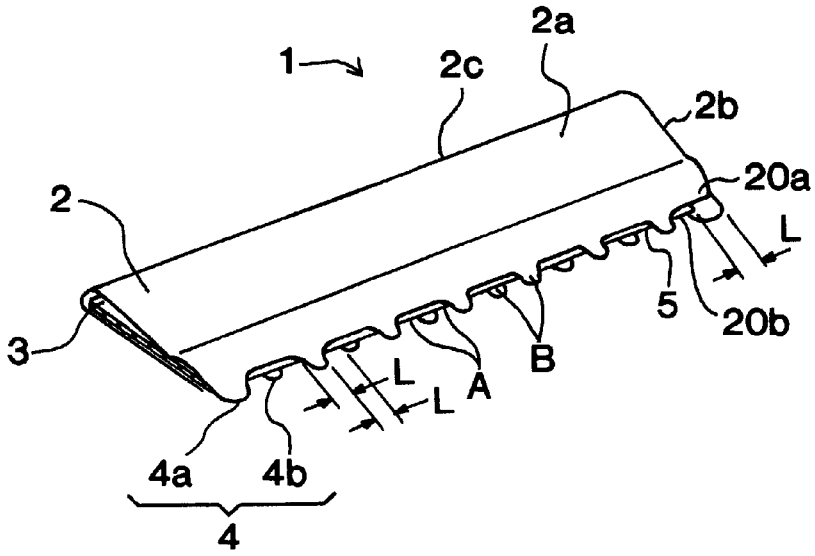
FIG. 1 is a perspective view of a razor blade unit according to an embodiment of the present invention.

In FIG. 1 is shown a blade unit 1 according to an embodiment of the present invention, comprising a blade holder 2 and a blade 3 slidably held in the blade holder 2 with its blade edge 5 partially protruding from holder edges 20*a* and 20*b*. The blade holder 2 comprises a holder surface 2*a* and surface 2*b* connected with a backbone 2*c*. Generally, such a blade holder is provided by bending a metal plate roughly along a centerline or in half. The surface 2*a* has a plurality of parabolic protrusions 4*a* provided along its edge 20*a* and the surface 2*b* has a plurality of parabolic protrusions 4*b* provided along its edge 20*b*. The parabolic protrusions 4*a* and 4*b* are generally of an identical size having a width L.

Preferably, the protrusions 4*a* and protrusions 4*b* appear alternately and together cover about 50% of the blade edge 5, leaving the other blade portions (about 50% altogether) uncovered. Advantageously, the length of each uncovered blade portion is also L. The covered blade portions are indicated by "B" and the uncovered blade portions are indicated by "A" in the figure. It is preferred that the covered blade portions B and the uncovered blade portions A appear alternately. Unlike a conventional blade unit where only either protrusions 4*a* or 4*b* are provided, this blade unit of the present invention can be adequately used in both hair cutting directions since the difference in cutting performance between the two cutting directions is totally eliminated.

Figure 2:
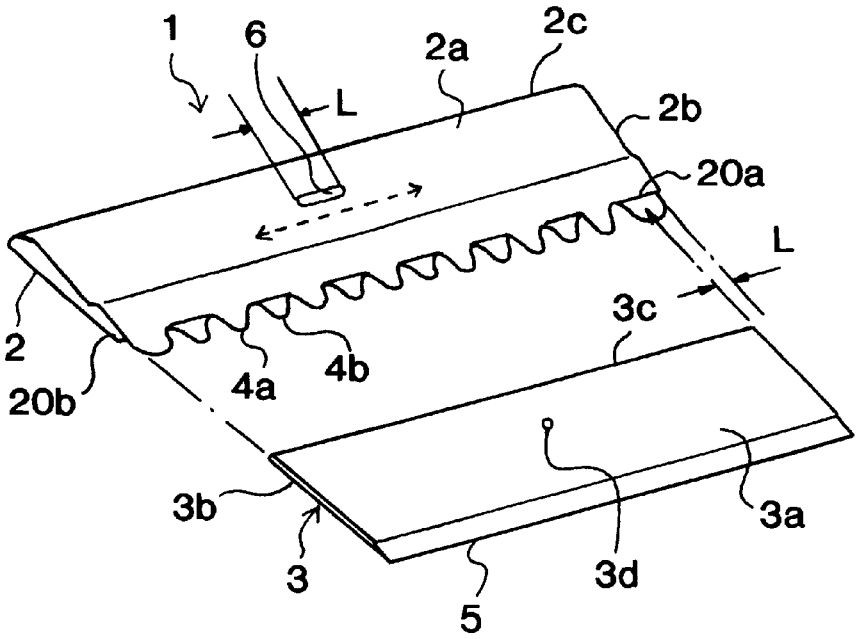
FIG. 2 is a perspective view of a razor blade unit according to another embodiment of the present invention having a blade sliding means.
Figure 3A:
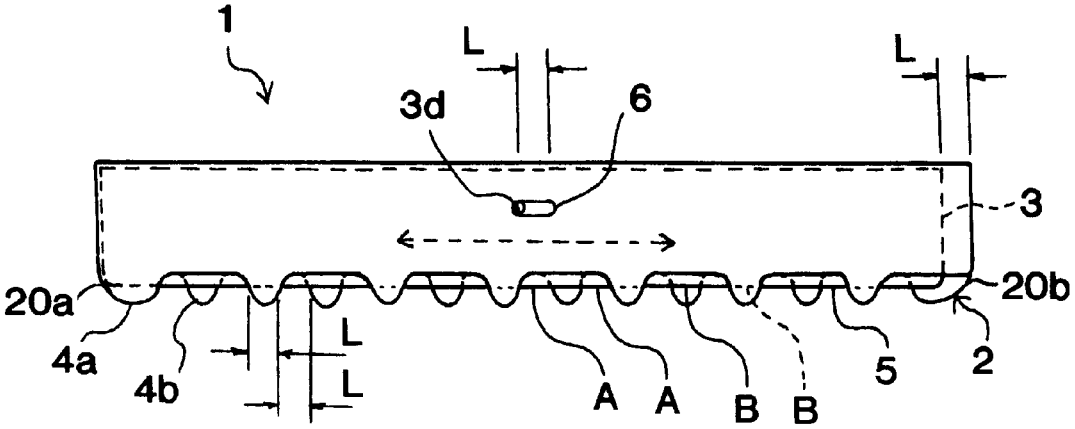
FIG. 3(*a*) is a plan view of the razor blade unit of FIG. 2 showing a position of the blade within a blade holder.
Figure 3B:
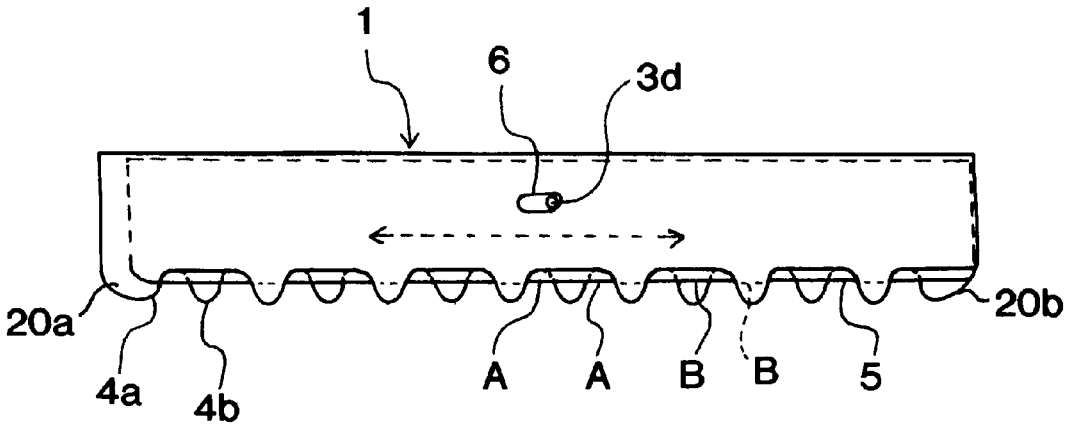

In FIG. 2 is shown another blade unit 1 of the present invention. This blade unit 1 is similar to the foregoing blade unit, the difference being a blade sliding means additionally provided in the blade unit 1, comprising an elliptic window 6 having a length of about L provided in the holder surface 2*a* and a boss 3*d* provided on the blade surface 3*a*, which is received within the window 6 when the blade 3 is attached to the blade holder 2. The boss 3*d* can be moved with a finger within the window 6 so that the blade 3 slidably held in the holder 2 can be moved together within the holder 2 in the directions indicated by broken arrows to convert the covered blade portions B into uncovered blade portions A, and vice versa. The life of the blade 3 or blade edge 5 can be elongated theoretically twice as long. FIGS. 3(*a*) and 3(*b*) show the two positions of the blade 3 within the holder 2. Together with the boss 3*d*, the blade 3 slides within the holder 2 in both directions indicated by broken arrows, where in FIG. 3(*a*) the blade 3 held at the left position shows the uncovered blade portions A for cutting hair and in FIG. 3(*b*) the blade 3 held at the right position shows the other fresh uncovered blade portions A for cutting hair which are formally the covered blade portions B in FIG. 3(*a*).

The window 6 can be a through opening 6 formed in the holder surfaces 2*a* and 2*b*. The boss 3*d* can be a through hole 3*d* formed in the blade 3. When a combination of such a through opening 6 and hole 3*d* is utilized, the sliding of the blade 3 within the holder 2 can be furnished with a pin by inserting the pin in the hole 3*d*.

Figure 4:
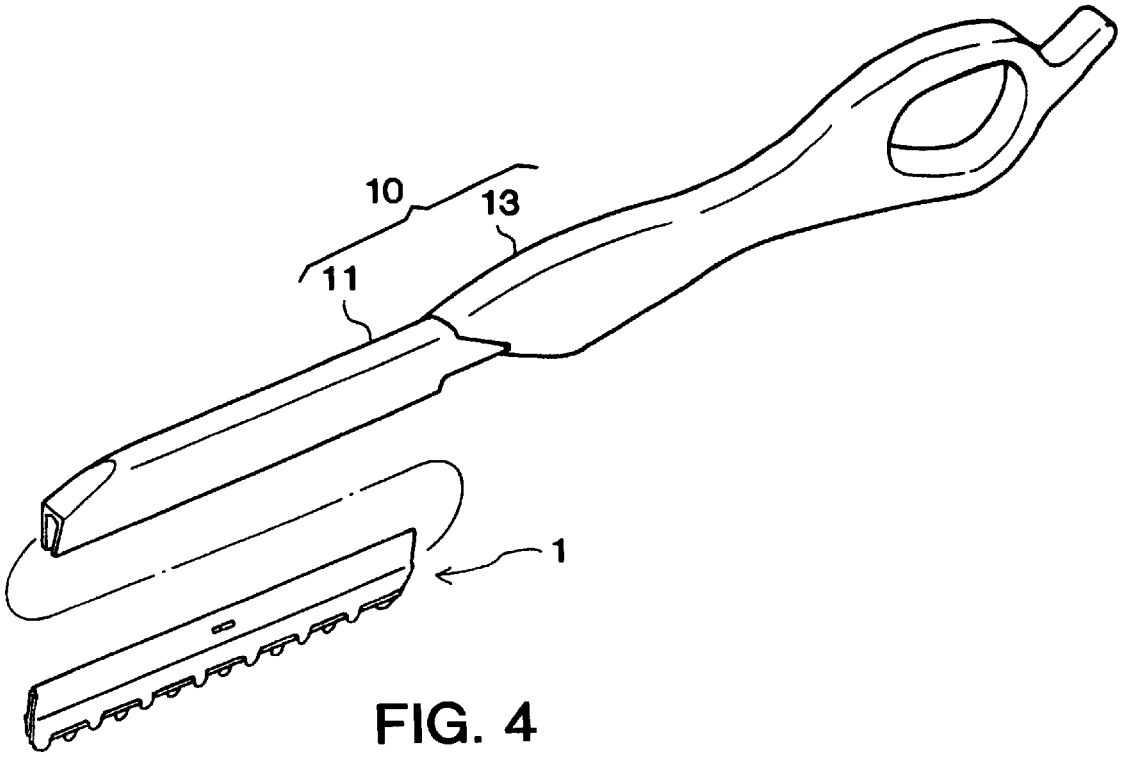
FIG. 4 is a perspective view of a blade unit holder.

In FIG. 4 is shown a blade unit holder 10 comprising a holder casing 11 and a grip 13. A blade unit 1 of the present invention is inserted into the holder casing 11 for use. The conversion of blade portions A and B of the blade unit 1 is performed as required before the insertion of the unit 1 into the holder casing 11.

Figure 5:
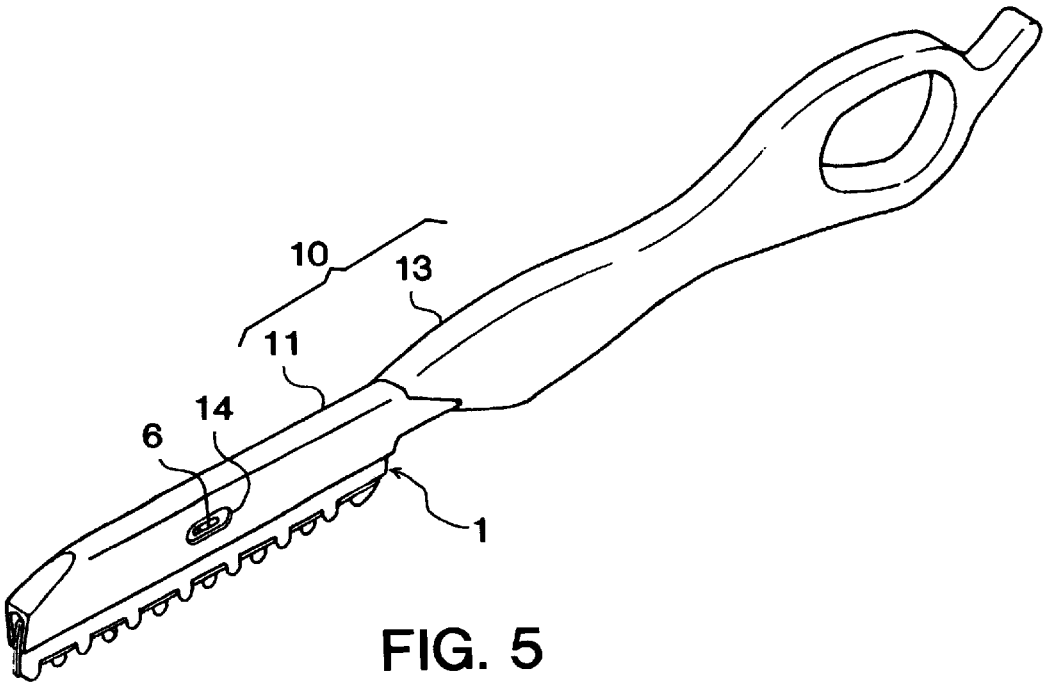
FIG. 5 is a perspective view of another blade unit holder having a window to facilitate use of a blade sliding means.

FIG. 5 shows another blade unit holder 10 which is similar to the foregoing blade unit holder. The only difference is that the holder casing 11 has an opening 14 which is considerably larger than the window 6 and can receive the window 6 when the blade unit 1 is inserted in the holder casing 11. The blade 3 can be moved within the blade holder 2 after the blade unit 1 is inserted in the blade unit holder 10. Alternatively, the opening 14 can be a through opening 14 formed in the holder casing 11 and the window 6 can be a through opening 6 where a through hole 3*d* is utilized.

Figure 6A:
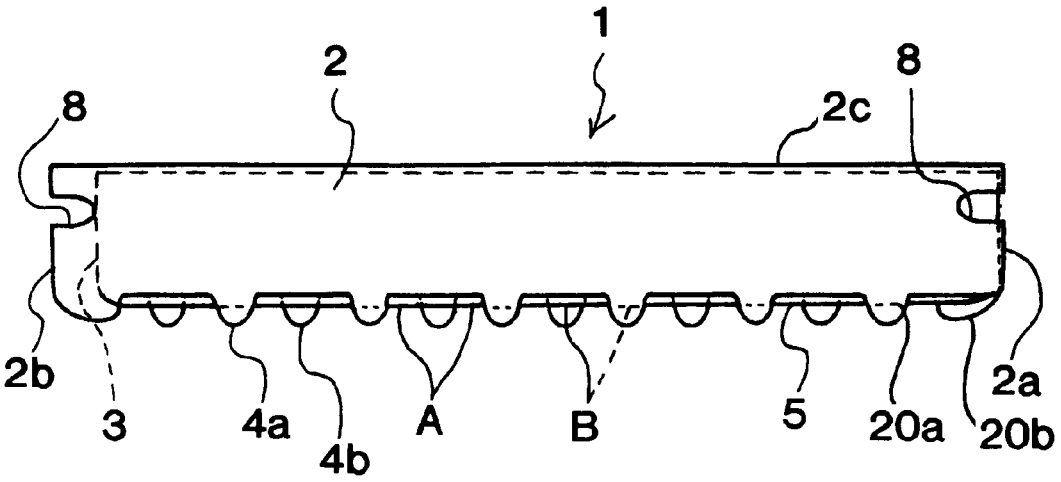
FIG. 6(*a*) is a plan view of a blade unit according to another embodiment of the present invention, showing a blade position.
Figure 6B:
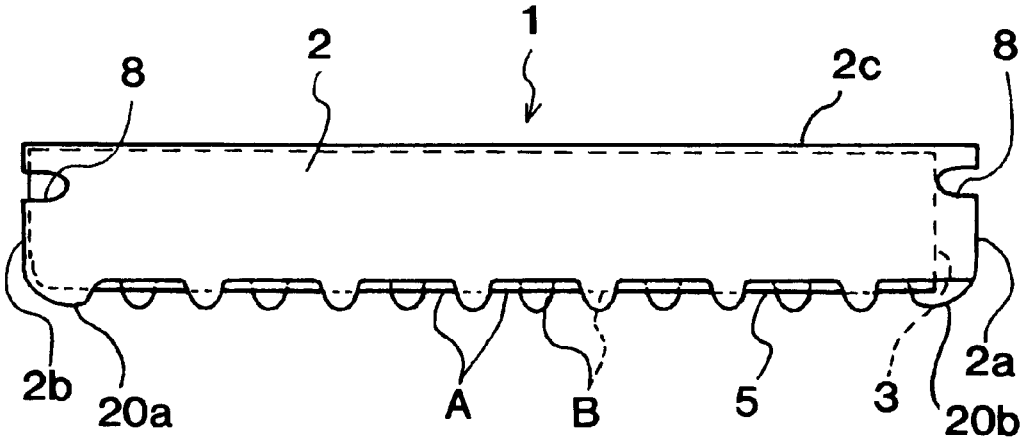

Another blade unit 1 is shown in FIGS. 6(*a*) and 6(*b*) prepared similarly with the foregoing blade units. This blade unit 1 is provided in place of the foregoing blade sliding means with parabolic cuts 8 each having a depth approximately corresponding to the width of each protrusion 4*a* or 4*b* on the distal and proximal ends of the blade holder 2. The blade 3 can be moved within the blade holder 2 for exchanging the blade portions A and B by pressing the blade portion in one of the cuts 8. FIG. 6(*a*) shows a position of the blade 3 within the blade holder 2 and FIG. 6(*b*) shows the other position of the blade 3.

Figure 7:
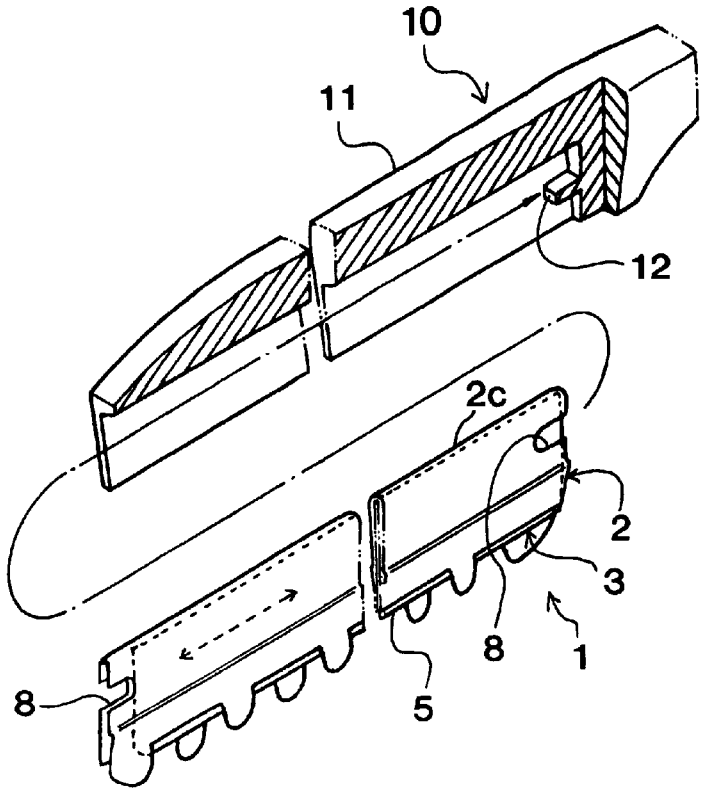
FIG. 7 is a partial perspective view of another blade unit holder, partially in section.

FIG. 7 partially shows another type of blade unit holder 10, partially in section. A projection 12 whose size, configuration and position correspond to those of the cut 8 is provided within the holder casing 11 such that the blade portion in the corresponding cut 8 can be pressed by the projection 12 when the blade unit 1 is inserted into the holder casing 11. For exchanging the blade portions A and B, the blade unit 1 is removed from the casing 11 and reinserted into the casing 11.

Figure 8:
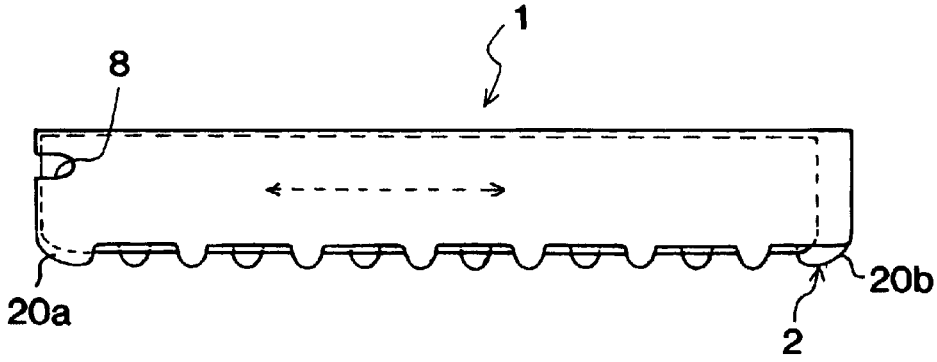
FIG. 8 is a plan view of a blade unit according to another embodiment of the present invention.

In FIG. 8 is shown a modification of the blade unit 1 described above. This blade unit 1 has only one such a cut 8 on a distal or proximal end of the blade holder 2, which facilitates a single time renewal of blade portions A and B.

Figure 9:
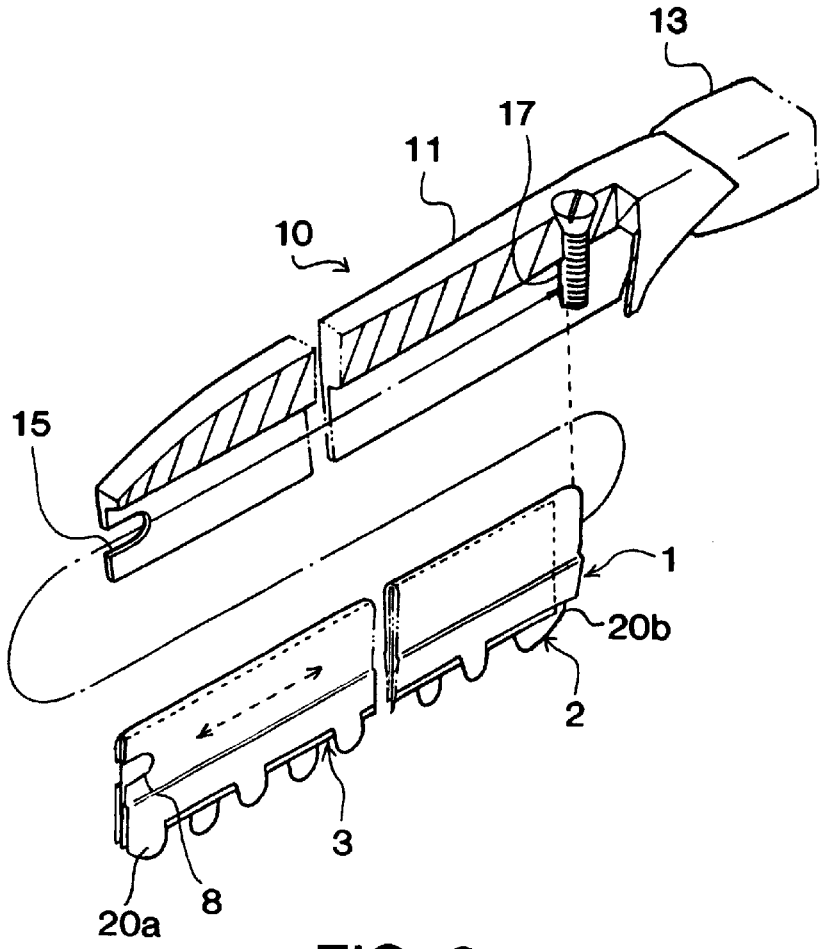
FIG. 9 is a partial perspective view of another blade unit holder.

FIG. 9 shows a blade unit holder 10 additionally having a parabolic cut 15 whose shape, size and position correspond to those of the cut 8 on the distal end of the holder casing 11, though it is advantageous to provide the cut 15 slightly larger than the cut 8. A bolt 17 is also provided within the holder casing 11 as a stopper of the blade unit 1. The blade portion in the cut 8 received in the parabolic cut 15 is pressed for renewal of the blade portions A with the blade portions B.

Figure 10:
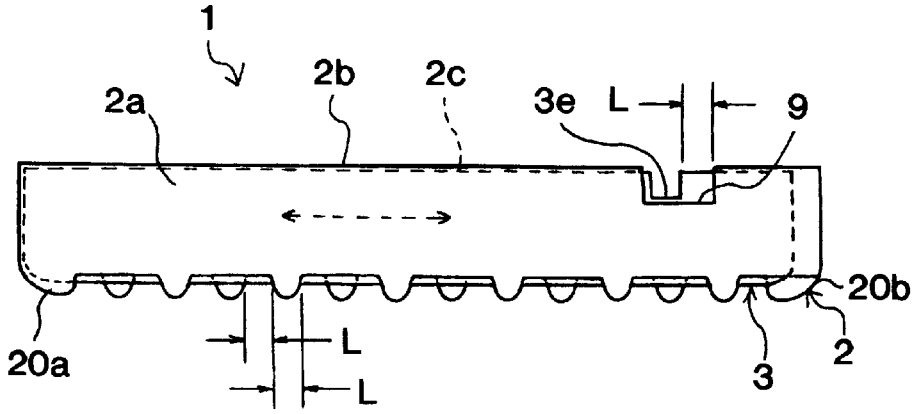
FIG. 10 is a plan view of a blade unit according to another embodiment of the present invention.

Still another blade unit 1 according to the present invention is shown in FIG. 10. The blade unit 1 has a different type of blade sliding means, comprising a generally rectangular cut 9 having a length of about 2L or twice the width of a protrusion 4*a* or 4*b* on the backbone 2*c* and a rectangular cut 3*e* having a length of about L or the width of each protrusion 4*a* or 4*b* on the non-blade edge of the blade 3 which is positioned to be received within the cut 9 of the holder 2. The blade 3 in the blade holder 2 can be moved by pushing or pulling the cut 3*e* within the cut 9 for renewal of blade portions A with the blade portions B.

Figure 11:
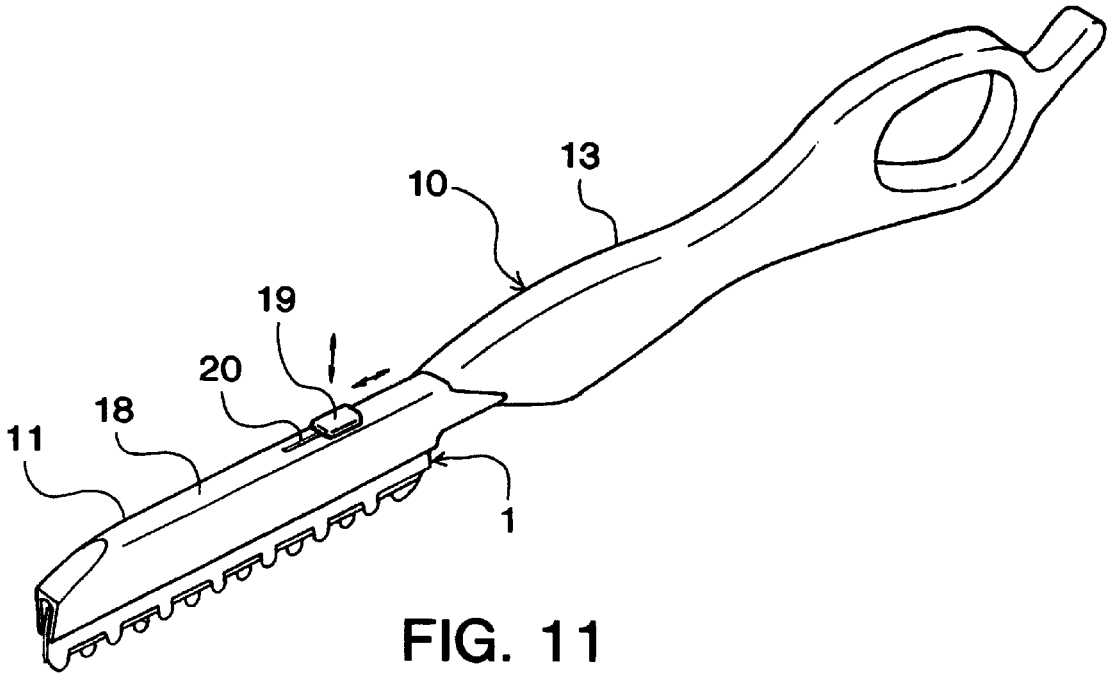
FIG. 11 is a perspective view of another blade unit holder incorporating a blade unit of the present invention having a blade sliding means.
Figure 12:
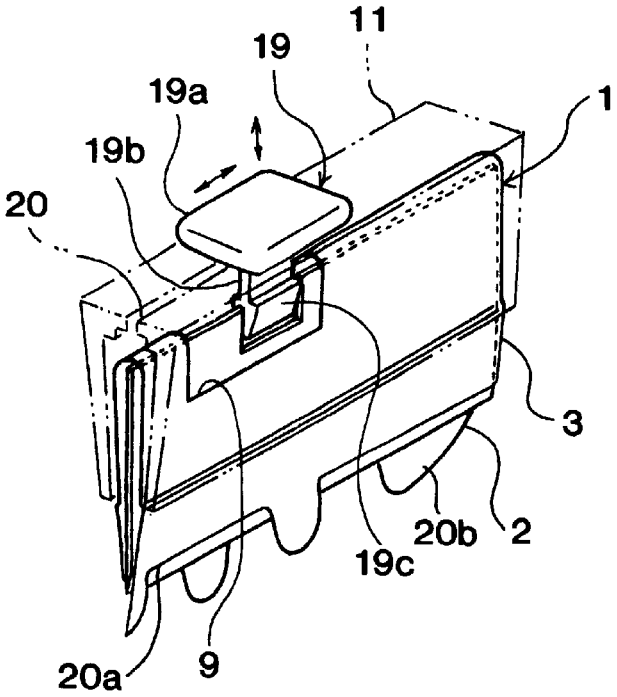
FIG. 12 is an enlarged partial perspective view showing the mechanism of the blade sliding means of FIG. 11 in detail.
Figure 13A:
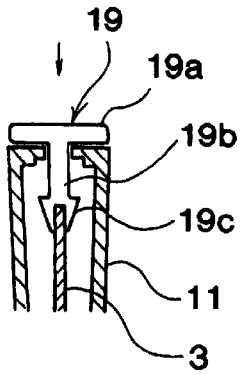
FIGS. 13(*a*) and 13(*b*) show two positions of the blade sliding means of FIG. 12.
Figure 13B:
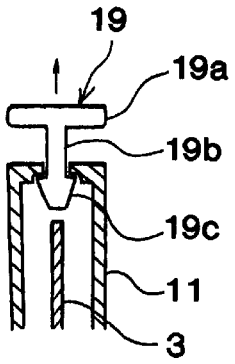
Figure 14:
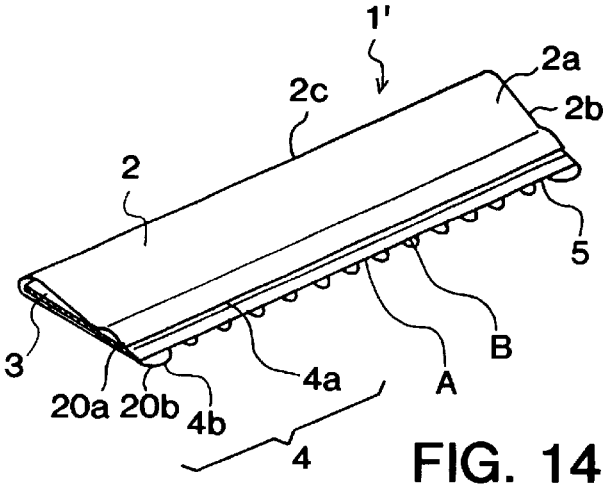
FIG. 14 PRIOR ART
FIG. 14 is a perspective view of a conventional blade unit.
Figure 15:
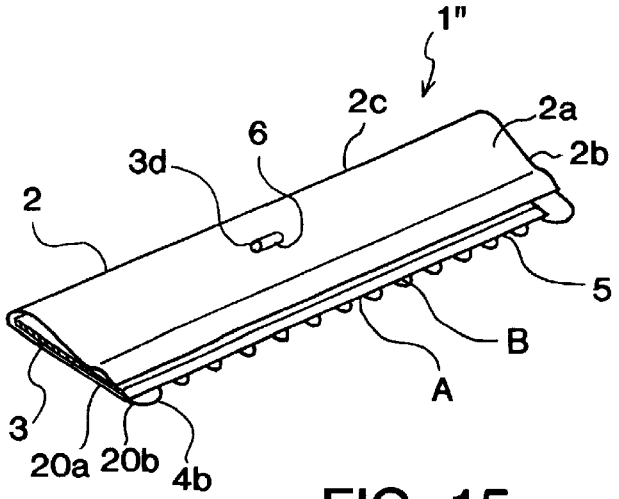
FIG. 15 PRIOR ART
FIG. 15 is a perspective view of another conventional blade unit having a blade sliding means.

FIG. 11 shows another blade unit holder 10 and a blade unit 1 mounted in the holder 10. The blade unit 1 for this holder 10 may be the blade unit shown in FIG. 10. Here, however, the blade 3 can be moved within the blade holder 2 as held within the holder casing 11 by means of a press button 19. The press button 19 comprises a flat top 19*a* and a leg 19*b* which can engage the cut 3*e* of the blade 3 when pressed down with a finger as shown in FIGS. 12 and 13(*a*) and 13(*b*), FIG. 12 being an enlarged view and FIG. 13(*a*) and 13(*b*) respectively showing the engaged position and disengaged position of the press button 19. The leg 19*b* engaged in the cut 3*e* can be pushed or pulled with finger pressure as applied on the flat top 19*a* for sliding the blade 3 within the blade holder 2.

The foregoing embodiments are provided to illustrate the present invention. It is possible for a person skilled in the art to modify the present invention within the teaching and spirit of the invention. The true scope of the invention is given by the attached claims.

What is claimed is:

1. A blade unit for a razor comb, comprising a blade having a cutting edge, and a blade holder for partially housing the blade, and a blade sliding means, wherein said blade holder has a first holder edge and a second holder edge parallel to each other and to the cutting edge of the blade, each holder edge having a plurality of generally parabolic protrusions arranged apart for combing hair which protrude beyond the cutting edge and partially cover the cutting edge, the protrusions of said first holder edge provided alternately with the protrusions of said second holder edge leaving a plurality of cutting edge portions uncovered for cutting hair, and said blade is slidably held in said blade holder so that unused portions of said cutting edge may be exposed without removing said blade from said blade holder.

2. A blade unit according to claim 1, wherein the covered cutting edge portions are provided alternately with the parabolic protrusions on said first holder edge and on said second holder edge.

3. A blade unit according to claim 2, wherein each of the uncovered cutting edge portions and each of the covered cutting edge portions have a substantially equal width.

4. A blade unit according to claim 1, wherein said blade sliding means comprises a window provided on said blade holder and a boss provided on said blade which is received within the window.

5. A blade unit according to claim 1, wherein said blade sliding means comprises a through opening formed in said blade holder and as boss provided on said blade which is received within the through opening.

6. A blade unit according to claim 1, wherein said blade sliding means comprises a through opening formed in said blade holder and a through hole formed in said blade which comes within the through opening.

7. A blade unit according to claim 1, wherein said blade sliding means comprises a cut formed on each end of said blade holder.

8. A blade unit according to claim 1, wherein said blade sliding means comprises a cut formed on an end of said blade holder.

9. A blade unit according to claim 1, wherein said blade sliding means comprises a first cut formed on a backbone of said blade holder and a second cut formed on a non-blade edge of said blade which is about half as wide as said first cut and comes within the first cut.

10. A blade unit for a razor comb, comprising:

a blade having a cutting edge; and a blade holder for housing said blade, said blade holder having a first holder edge and a second holder edge parallel to each other and to said cutting edge of said blade, each holder edge having a plurality of generally parabolic protrusions arranged apart for combing hair, said protrusions protruding beyond said cutting edge, said protrusions exposing first portions of said cutting edge and shielding second portions of said cutting edge, said blade holder having a cut in a first end edge, said first end edge perpendicular to said holder edges, said cut located and dimensioned such that it mates with a projection in a blade unit holder upon insertion into the blade unit holder, whereby said blade is repositioned inside said blade holder to expose said shielded second portions of said blade upon insertion of the blade holder into the blade unit holder, said cut mating with the projection, the projection pressing against the blade in the blade holder and repositioning the blade.

11. The blade unit of claim 10 wherein said blade holder has a second cut in a second edge perpendicular to said holder edges, whereby said blade may be returned to its original position in said blade unit by inserting said blade unit into the blade unit holder to mate the projection with said second cut thereby sliding said blade in said holder.

12. The blade unit of claim 10 wherein said protrusions on said first holder edge are offset in relation to said protrusions on said second holder edge.

13. A razor comb, comprising:

a blade having a cutting edge;

a blade holder for housing said blade, said blade holder having a first holder edge and a second holder edge parallel to each other and to said cutting edge of said blade, each holder edge having a plurality of generally parabolic protrusions arranged apart for combing hair, said protrusions protruding beyond said cutting edge, said protrusions exposing first portions of said cutting edge, said blade holder second portions of said cutting edge, said blade holder having a cut in a first end edge, said first end edge perpendicular to said holder edges; and a blade unit holder for housing said blade holder and said blade, said blade unit holder having a projection located and dimensioned to mate with said cut on said blade holder upon unsertion of said blade holder into said blade unit holder, said projection to push said blade thereby repositioning said blade inside said blade holder.

* * * * *